US009786221B2

(12) United States Patent
Bae et al.

(10) Patent No.: US 9,786,221 B2
(45) Date of Patent: Oct. 10, 2017

(54) ORGANIC LIGHT EMITTING DISPLAY DEVICE AND METHOD OF DRIVING THE SAME

(71) Applicant: SAMSUNG DISPLAY CO., LTD., Yongin, Gyeonggi-Do (KR)

(72) Inventors: Min Seok Bae, Asan-si (KR); Sung Hoon Bang, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/619,033

(22) Filed: Feb. 10, 2015

(65) Prior Publication Data

US 2016/0140901 A1 May 19, 2016

(30) Foreign Application Priority Data

Nov. 17, 2014 (KR) ..... 10-2014-0160094

(51) Int. Cl.
*G09G 3/30* (2006.01)
*G09G 3/3233* (2016.01)

(52) U.S. Cl.
CPC ... *G09G 3/3233* (2013.01); *G09G 2300/0842* (2013.01); *G09G 2320/0233* (2013.01); *G09G 2320/0271* (2013.01); *G09G 2320/048* (2013.01)

(58) Field of Classification Search
None
See application file for complete search history.

(56) References Cited

U.S. PATENT DOCUMENTS

2014/0168192 A1* 6/2014 Jeong ..... G09G 3/3208 345/212
2014/0176409 A1* 6/2014 Kim ..... G09G 3/3233 345/92
2014/0176617 A1* 6/2014 Jeong ..... G09G 3/2003 345/690
2015/0130866 A1 5/2015 Bae et al.
(Continued)

FOREIGN PATENT DOCUMENTS

JP 2006-195312 A 7/2006
KR 10-2005-0026338 A 3/2005
(Continued)

OTHER PUBLICATIONS

U.S. Office action dated Feb. 9, 2017, for cross reference U.S. Appl. No. 14/692,547, 27 pages.

*Primary Examiner* — Ifedayo Iluyomade
(74) *Attorney, Agent, or Firm* — Lewis Roca Rothgerber Christie LLP

(57) ABSTRACT

An organic light emitting display device includes: a display panel including a plurality of sub-pixels, each of the sub-pixels including an organic light emitting device to be light-emitted by a data current based on a data voltage; a memory to store accumulated data to be displayed on each of the sub-pixels; a deterioration compensator including: a compensation scheme determiner; a compensation amount calculator; and a modulation data generation generator; a timing controller to arrange the modulation data of each of the sub-pixels as pixel data according to a pixel arrangement structure of the display panel; and a data driver to convert the pixel data into the data voltage.

17 Claims, 7 Drawing Sheets

(56) References Cited

U.S. PATENT DOCUMENTS

| | | | |
|---|---|---|---|
| 2015/0193905 | A1 | 7/2015 | Lee et al. |
| 2016/0140901 | A1 | 5/2016 | Bae et al. |

FOREIGN PATENT DOCUMENTS

| | | | |
|---|---|---|---|
| KR | 10-2006-0112993 | A | 11/2006 |
| KR | 10-2006-0112995 | A | 11/2006 |
| KR | 10-2009-0058788 | A | 6/2009 |
| KR | 10-2013-0002118 | A | 1/2013 |
| KR | 10-2013-0064552 | A | 6/2013 |
| KR | 10-2014-0000787 | | 1/2014 |
| KR | 10-2014-0056799 | A | 5/2014 |
| KR | 10-2015-0054124 | | 5/2015 |
| KR | 10-2015-0081123 | | 7/2015 |

* cited by examiner

ORGANIC LIGHT EMITTING DISPLAY DEVICE AND METHOD OF DRIVING THE SAME

CROSS-REFERENCE TO RELATED APPLICATION

This application claims priority to and the benefit of Korean Patent Application No. 10-2014-0160094 filed on Nov. 17, 2014 in the Korean Intellectual Property Office, and all the benefits accruing therefrom under 35 U.S.C. 119, the contents of which in its entirety are herein incorporated by reference.

BACKGROUND

1. Field

Aspects of some example embodiments of the present invention relate to an organic light emitting display device and a method of driving the same.

2. Description of the Related Art

Recently, various flat panel display devices having reduced weight and volume, when compared to the cathode ray tube, are being developed. Some examples of flat panel display devices are a liquid crystal display, a field emission display, a plasma display panel, and an organic light emitting display.

Of these, the organic light emitting display device displays an image by using organic light emitting diodes, which generate light by recombination of electrons and holes. Such an organic light emitting display device has a quick response speed and is operated with low consumption of power.

However, in order to have a uniform quality, a pixel circuit of the organic light emitting display device may compensate for the characteristic difference of the thin film transistor (TFT) within the pixel. Further, as time passes, the efficiency of the organic light emitting display device may be reduced due to the deterioration of the organic matter, and thereby the luminance may be reduced. For example, if the organic light emitting device is deteriorated, the self-resistance increases, and as such, the current flowing into the organic light emitting device is reduced according to the same voltage, and thereby the luminance is reduced.

The above information disclosed in this Background section is only for enhancement of understanding of the background of the invention, and therefore, it may contain information that does not form the prior art that is already known to a person of ordinary skill in the art.

SUMMARY

One or more aspects of the present invention provides an organic light emitting display device capable of reducing luminance deterioration and luminance deviation (or variation) due to deterioration of the organic fight emitting device, and a method of driving the same.

According to an example embodiment of the present invention, an organic light emitting display device includes: a display panel including a plurality of sub-pixels, each of the sub-pixels including an organic light emitting device configured to be light-emitted by a data current based on a data voltage; a memory configured to store accumulated data to be displayed on each of the sub-pixels; a deterioration compensator including: a compensation scheme determiner configured to determine a deterioration compensation scheme for each sub-pixel based on the accumulated data of each of the sub-pixels stored in the memory; a compensation amount calculator configured to calculate a deterioration compensation amount for increasing or decreasing luminance of each of the sub-pixels according to the determined compensation scheme; and a modulation data generator configured to generate modulation data of each of the sub-pixels by modulating input data to be supplied to each of the sub-pixels according to the deterioration compensation amount; a timing controller configured to arrange the modulation data of each of the sub-pixels as pixel data according to a pixel arrangement structure of the display panel; and a data driver configured to convert the pixel data into the data voltage.

The compensation scheme determiner may be configured to determine a first scheme as the compensation scheme when the accumulated data is less than or equal to a first reference value, and to determine a combined scheme of the first scheme and a second scheme when the accumulated data is greater than the first reference value.

The compensation amount calculator may be configured to calculate the deterioration compensation amount by gradually increasing or decreasing the deterioration compensation amount according to application of the first scheme, when the combined scheme of the first scheme and the second scheme is determined to be the compensation scheme.

The compensation amount calculator may be configured to calculate a difference value between the deterioration compensation amount according to the application of the first scheme and the deterioration compensation amount according to the application of the second scheme, and to calculate the deterioration compensation amount by adding or deducting a size of the difference value to or from the deterioration compensation amount according to application of the first scheme by the size of the difference value for each of a plurality of compensation points of time, when the combined scheme of the first scheme and the second scheme is determined to be the compensation scheme.

The first scheme may be a deterioration compensation scheme that utilizes a look-up table comprising the deterioration compensation amount compared to the accumulated data of each of the sub-pixels or a deterioration compensation scheme that utilizes a relational equation utilizing the accumulated data as a variable and the deterioration compensation amount as an output.

The second scheme may be a scheme that compensates deterioration based on a data current which flows through the organic light emitting device.

The display panel may include a first sub-pixel and a second sub-pixel, and a first reference value corresponding to the first sub-pixel may be different from a first reference value corresponding to the second sub-pixel, or a second reference value corresponding to the first sub-pixel may be different form a second reference value corresponding to the second sub-pixel.

The deterioration compensator may further include a data accumulator configured to accumulate the input data in the accumulated data of the sub-pixels, and to store the accumulated input data in the memory.

The compensation scheme determiner may be configured to determine a first scheme as the compensation scheme when the accumulated data is less than or equal to a first reference value, to determine a combined scheme of the first scheme and a second scheme as the compensation scheme when the accumulated data is greater than the first reference value but less than or equal to a second reference value, and to determine the second scheme as the compensation value when the accumulated data is greater than the second reference value.

The compensation amount calculator may be configured to gradually decrease a deterioration compensation ratio of the first scheme, and to gradually increase the deterioration compensation scheme of the second scheme to calculate the deterioration compensation amount, when the combined scheme of the first scheme and the second scheme is determined to be the compensation scheme.

The compensation amount calculator may be configured to gradually decrease a deterioration compensation ratio of the first scheme along with the increase of the accumulated data, and to gradually increase a deterioration compensation ratio of the second scheme along with the increase of the accumulated data to calculate the deterioration compensation amount, when the combined scheme of the first scheme and the second scheme is determined to be the compensation scheme.

The first scheme may be a deterioration compensation scheme that utilizes a look-up table comprising the deterioration compensation amount compared to the accumulated data of each of the sub-pixels or a deterioration compensation scheme that utilizes the accumulated data as a variable and a relational equation that utilizes the deterioration compensation amount as an output.

The second scheme may compensate deterioration based on a data current which flows through the organic light emitting device.

The display panel may include a first sub-pixel and a second sub-pixel, and a first reference value corresponding to the first sub-pixel may be different from a first reference value corresponding to the second sub-pixel, or a second reference value corresponding to the first sub-pixel may be different from a second reference value corresponding to the second sub-pixel.

The deterioration compensator may further include a data accumulator configured to accumulate the input data in the accumulated data of the sub-pixels, and to store the accumulated input data in the memory.

According to another example embodiment of the present invention, a method of driving an organic light emitting display device including a display panel including a plurality of sub-pixels, each of the sub-pixels including an organic light emitting device configured to be light-emitted by a data current based on a data voltage, the method includes: determining a deterioration compensation scheme for each of the sub-pixels based on accumulated data of each of the sub-pixels stored in a memory; calculating a deterioration compensation amount for increasing or decreasing luminance of each of the sub-pixels according to the determined compensation scheme; generating modulation data of each of the sub-pixels by modulating input data to be supplied to each of the sub-pixels according to the deterioration compensation amount; arranging the modulation data of each of the sub-pixels as pixel data according to a pixel arrangement structure of the display panel; and converting the pixel data as the data voltage.

The method may further include: comparing whether the accumulated data of each of the sub-pixels stored in the memory is less than or equal to a first reference value; determining a first scheme as the deterioration compensation scheme when the accumulated data is less than or equal to the first reference value; and determining a combined scheme of the first scheme and a second scheme when the accumulated data is greater than the first reference value but less than or equal to a second reference value.

The determining of the deterioration compensation scheme may include: comparing whether the accumulated data of each of the sub-pixels stored in the memory is less than or equal to a first reference value; determining a first scheme as the deterioration compensation scheme when the accumulated data is less than or equal to the first reference value; determining a combined scheme of the first scheme and a second scheme as the compensation scheme when the accumulated data is greater than the first reference value but less than or equal to a second reference value; and determining the second scheme as the compensation scheme when the accumulated data is greater than the second reference value.

The first scheme may be a deterioration compensation scheme that utilizes a look-up table comprising the deterioration compensation amount compared to the accumulated data of each of the sub-pixels or a deterioration compensation scheme that utilizes the accumulated data as a variable and utilizes a relational equation that utilizes the deterioration compensation amount as an output.

The second scheme may compensate deterioration based on a data current that flows through the organic light emitting device.

BRIEF DESCRIPTION OF THE DRAWINGS

The above and other features and aspects of the present invention will become more apparent by describing in detail the example embodiments thereof with reference to the attached drawings in which.

DETAILED DESCRIPTION

Figure 1:
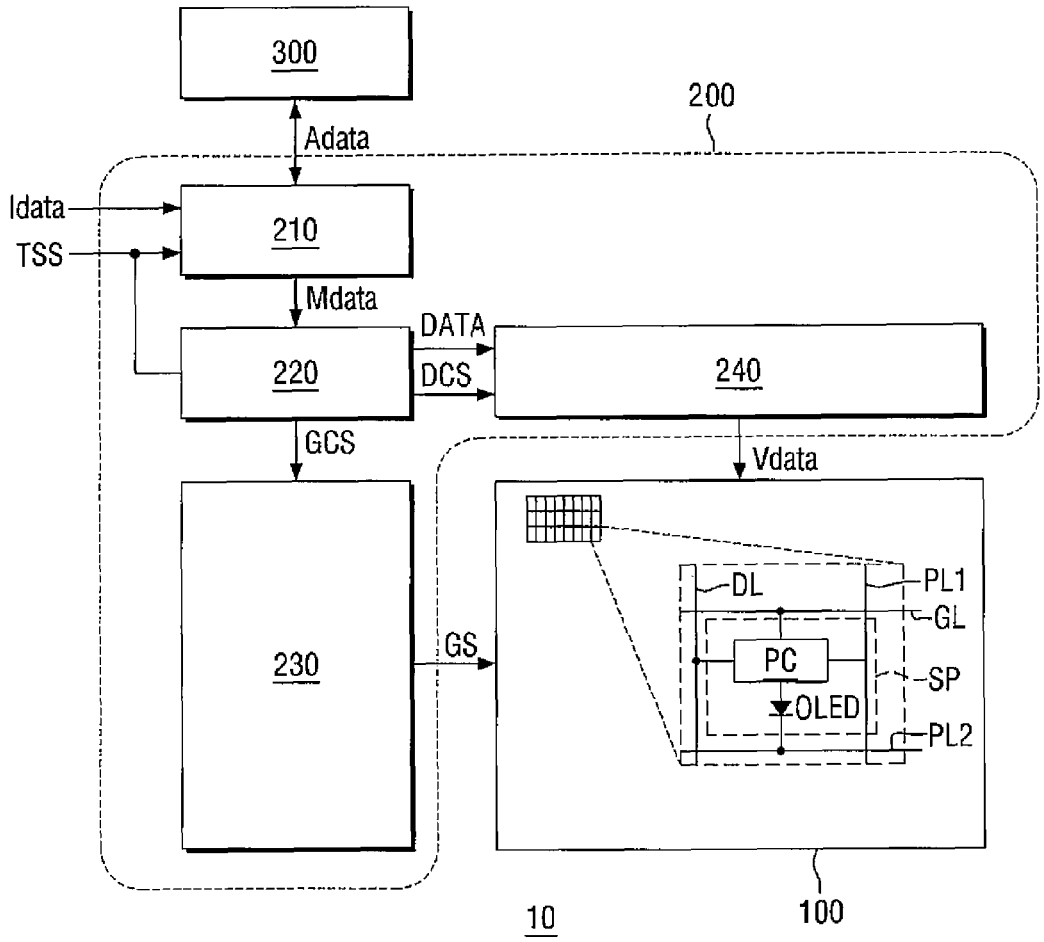
FIG. 1 illustrates a configuration of an organic light emitting display device according to an embodiment of the present invention.

Reference will now be made in detail to exemplary embodiments, examples of which are illustrated in the accompanying drawings, wherein like reference numerals refer to like elements throughout. In this regard, the exemplary embodiments described herein may have various different forms and should not be construed as being limited to the descriptions set forth herein. Accordingly, the exemplary embodiments are merely described below, by referring to the figures, to describe aspects of the present invention.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, an organic light emitting display device and a method of driving the same according to some example embodiments of the present invention will be described with reference to the attached drawings.

FIG. 1 illustrates a configuration of an organic light emitting display device according to an embodiment of the present invention.

Referring to FIG. 1, the organic light emitting display device 10 according to an embodiment of the present invention includes a display panel 100, a panel driving unit 200 (e.g., a panel driver), and a memory 300.

The display panel 100 includes a plurality of sub-pixels SP. The plurality of sub-pixels SP is formed on the pixel area, which is defined by a plurality of gate lines GL and a plurality of data lines DL that cross each other. Further, a plurality of driving voltage lines PL1, where the driving voltage is supplied from the panel driving unit 200, may be formed in parallel (e.g., side by side) with each of the plurality of data lines DL.

Each of the plurality of sub-pixels SP may be one of a red sub-pixel, a green sub-pixel, a blue sub-pixel, and a white sub-pixel. One unit pixel, which displays one image (e.g., emits light), may include an adjacent red sub-pixel, a green sub-pixel, a blue sub-pixel, and a white sub-pixel, or may include a red sub-pixel, a green sub-pixel, and a blue sub-pixel.

Each of the plurality of sub-pixels SP includes an organic light emitting device (OLED) and a pixel circuit PC.

The organic light emitting device (OLED) is connected between the pixel circuit PC and a second driving power line PL2, and emits light in proportion to the amount of the data current, which is supplied from the pixel circuit PC, so as to emit color light (e.g., predetermined color light). Thus, the OLED includes an anode electrode (or a pixel electrode), which is connected to the pixel circuit PC, a cathode electrode (or a reflective electrode), which is connected to the second driving power line PL2, and a light emitting cell, which emits light of one of red, green, blue, or white colors. Here, the light emitting cell may have a structure of a hole transport layer, an organic light emitting layer, and an electron transport layer, or a structure of a hole injection layer, a hole transport layer, an organic light emitting layer, an electron transport layer, and an electron injection layer. Further, the light emitting cell may additionally include a functional layer for improving the light emitting efficiency and/or lifespan of the organic light emitting layer.

The pixel circuit PC supplies the data current corresponding to the data voltage Vdata, which is supplied to the data line DL from the panel driving unit 200, to the OLED, in response to the gate signal GS having the gate on voltage level, which is supplied to the gate line GL from the panel driving unit 200. At this time, the data voltage Vdata may have a voltage value of which deterioration characteristic of the OLED has been compensated.

Figure 2:
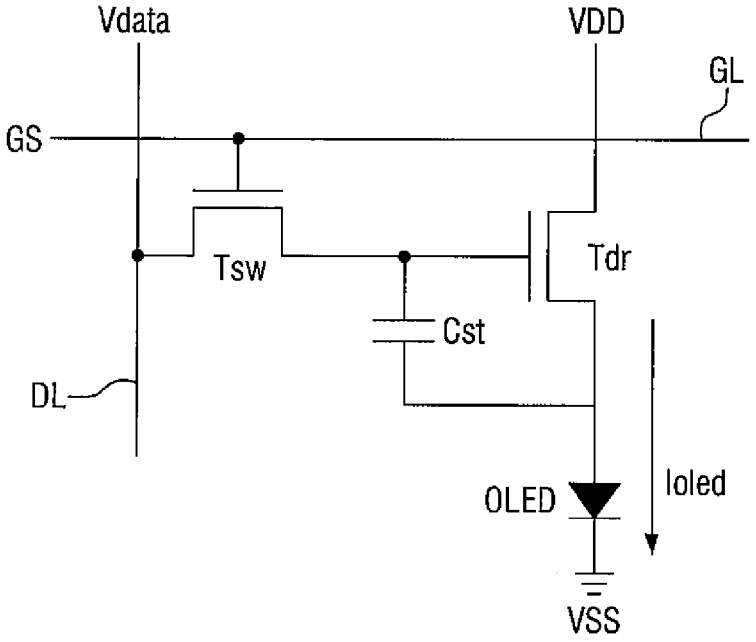
FIG. 2 is a pixel circuit diagram of an organic light emitting display device according to an embodiment of the present invention.

FIG. 2 is a pixel circuit diagram of an organic light emitting display device according to an embodiment of the present invention.

Referring to FIG. 2, the pixel circuit PC may include a switching transistor Tsw, a driving transistor Tdr, and at least one capacitor Cst. However, the pixel circuit in FIG. 2 is merely an example, and the configuration of the pixel circuit is not limited to the example of FIG. 2.

The switching transistor Tsw supplies the data voltage Vdata from the data line DL to the driving transistor Tdr, in response to the gate signal GS supplied from the gate line GL. The driving transistor Tdr controls the data current Ioled flowing to the OLED from the driving voltage VDD, in response to the data voltage Vdata supplied from the switching transistor Tsw. The capacitor Cst may be connected between the gate terminal and the source terminal of the driving transistor Tdr to store the voltage corresponding to the data voltage Vdata, which is supplied to the gate terminal of the driving transistor Tdr, and to turn on the driving transistor Tdr with the stored voltage.

The OLED is electrically connected between the source terminal of the driving transistor Tdr and the cathode voltage VSS, which is applied to the cathode electrode of the OLED, and emits light according to the data current Ioled, which is supplied from the driving transistor Tdr.

Each sub-pixel SP of the organic light emitting display device 10 may display an image (e.g., a predetermined image) by light-emitting the OLED according to the amount of the data current lobed, which flows to the OLED from the driving voltage VDD through the switching of the driving transistor Tdr according to the data voltage Vdata.

The panel driving unit 200 may calculate the amount of the deterioration compensation to be applied to each sub-pixel SP based on the accumulated data Adata of each sub-pixel stored in the memory 300, and may modulate the input data Idata of each sub-pixel SP according to the calculated amount of deterioration compensation. Further, the panel driving unit 200 may convert the modulation data Mdata of each sub-pixel SP into the data voltage Vdata, so as to be supplied to each sub-pixel SP. Further, the panel driving unit 200 may accumulate and store the input data Idata of each sub-pixel in the memory 300.

The memory 300 may store the accumulated data, wherein the input data Idata for each sub-pixel SP has been accumulated until the previous frame just prior to the current frame, in respective sub-pixel SP units, and may provide the stored accumulated, data to the panel driving unit 200. The accumulated data Adata of each sub-pixel SP, which is stored in the memory 300, may not be initialized, and may be continually accumulated while the organic light emitting display device 10 operates.

The panel driving unit 200 may include a deterioration compensation unit 210 (e.g., a deterioration compensator), a timing controller 220, a gate driving circuit unit 230 (e.g., a gate driver), and a data driving circuit unit 240 (e.g., a data driver).

The deterioration compensation unit 210 may calculate the amount of deterioration compensation to be applied to each sub-pixel SP based on the accumulated data Adata of each sub-pixel SP, which is accumulated in the memory 300, and may modulate the input data Idata to be supplied to each sub-pixel SP according to the calculated amount of deterioration compensation, so as to generate the modulation data Mdata of each sub-pixel. The deterioration compensation unit 210 may supply the modulation data Mdata of each sub-pixel SP to the timing controller 220. Further, the deterioration compensation unit 210 may accumulate the input data Idata of each sub-pixel, and may store the accumulated input data Idata in the memory 300.

The timing controller 220 controls the driving timing of each of the gate driving circuit unit 230 and the data driving circuit unit 240 according to the timing synchronization signal TSS, which is inputted from an external system body or a graphic card. That is, the timing controller 220 may generate a gate control signal GCS and a data control signal DCS based on a vertical synchronization signal, a horizontal synchronization signal, a data enable signal, and the timing synchronization signal TSS, such as a dot clock, may control the driving timing of the gate driving circuit unit 230 through the gate control signal GCS, and may control the driving timing of the data driving circuit unit 240 through the data control signal DCS synchronized therewith.

The timing controller 220 may arrange the modulation data Mdata of each sub-pixel SP as the pixel data to fit the pixel arrangement structure of the display panel, and may supply the arranged pixel data DATA to the data driving circuit unit 240 based on an interface scheme (e.g., a predetermined interface scheme).

In other embodiments, the timing controller 220 may include the deterioration compensation unit 210. In this case, the deterioration compensation unit 210 may be mounted in the timing controller 220, and may be mounted in the form of a program or logic.

The gate driving circuit unit 230 may generate a gate signal GS corresponding to the display order of images based on the gate control signal GCS, which is supplied from the timing controller 220, and may supply the generated gate signal GS to the gate line GL. The gate driving circuit unit 230 may be implemented as a plurality of integrated circuits IC, or may be directly arranged on the substrate of the display panel 100 along with the process of forming a transistor of each sub-pixel SP, or may be connected to one or both sides of each of a plurality of gate lines GL.

The data driving circuit unit 240 may be supplied with pixel data DATA and data control signals DCS from the timing controller 220, and may be supplied with a plurality of reference gamma voltages from an external reference gamma voltage supply unit (e.g., a reference gamma voltage supplier). The data driving circuit unit 240 may convert the pixel data DATA into a data voltage Vdata of an analog voltage by using the plurality of reference gamma voltages according to a data control signal DCS, and may supply the converted data voltage Vdata to the data line DL of the sub-pixel SP. The data driving circuit unit 240 may be implemented as a plurality of integrated circuits IC, and may be connected to one or both sides of each of a plurality of data lines DL.

Hereinafter, the deterioration compensation unit 210 of the organic light emitting display device 10 according to an embodiment of the present invention will be described in detail.

Figure 3:
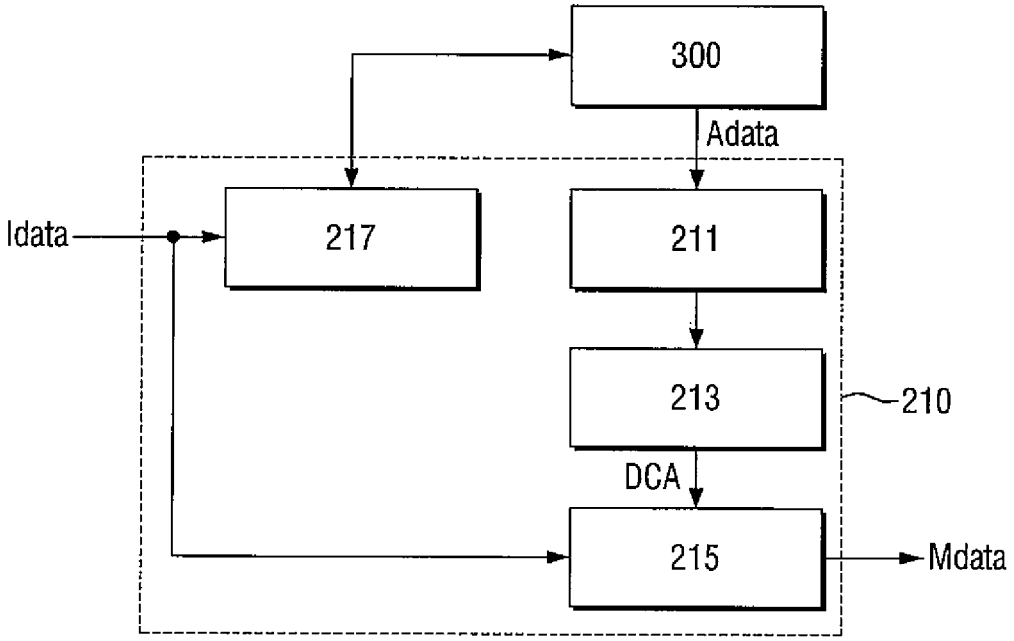
FIG. 3 is a block diagram illustrating a deterioration compensation unit of an organic light emitting display device according to an embodiment of the present invention.

FIG. 3 is a block diagram for describing a deterioration compensation unit of an organic light emitting device according to an embodiment of the present invention.

Referring to FIG. 3, the deterioration compensation unit 210 of the organic light emitting display device 10 includes a compensation scheme determination unit 211 (e.g., a compensation scheme determiner), a compensation amount calculation unit 213 (e.g., a compensation amount calculator), a modulation data generation unit 215 (e.g., a modulation data generator), and a data accumulation unit 217 (e.g., a data accumulator).

The compensation scheme determination unit 211 determines the deterioration compensation scheme for each sub-pixel SP based on the accumulated data Adata of each of the sub-pixels SP, which are stored in the memory 300. The compensation scheme determination unit 211 may appropriately change the deterioration compensation scheme based on the accumulated data Adata of each sub-pixel SP for every compensation point of time, and thus, effective compensation according to the level of deterioration may be possible. The determination of the deterioration compensation scheme may be performed for every deterioration compensation point of time.

The compensation amount calculation unit 213 calculates the deterioration compensation amount DCA for increasing or reducing the luminance of each sub-pixel SP for every compensation point of time according to the deterioration compensation scheme, which is determined by the compensation scheme determination unit 211. The deterioration compensation amount DCA may include luminance data to be compensated at the corresponding compensation point of time.

The modulation data generation unit 215 generates modulation data Mdata of each sub-pixel SP by modulating the input data Idata to be supplied to each sub-pixel SP according to the deterioration compensation amount DCA, which is calculated by the compensation amount calculation unit 213.

The data accumulation unit 217 may accumulate current input data Idata in the accumulated data Adata of each sub-pixel SP stored in the memory 300 in respective sub-pixel SP units, and may store the accumulated input data Idata in the memory 300.

The compensation scheme determination unit 211 of the organic light emitting display device 10 according to an embodiment of the present invention may determine a combined scheme of the existing compensation scheme and a compensation scheme to be changed as the compensation scheme during a time or section (e.g., a predetermined time or section) in which the compensation scheme is changed to minimize or reduce the display image change according to the change of the compensation scheme.

In some embodiments, the compensation scheme determination unit 211 may determine a first scheme as the compensation scheme if the accumulated data Adata of each sub-pixel SP is a first reference value or less, and may determine the combined scheme of the first scheme and a second scheme as the compensation scheme when the accumulated data exceeds the first reference value.

Figure 4:
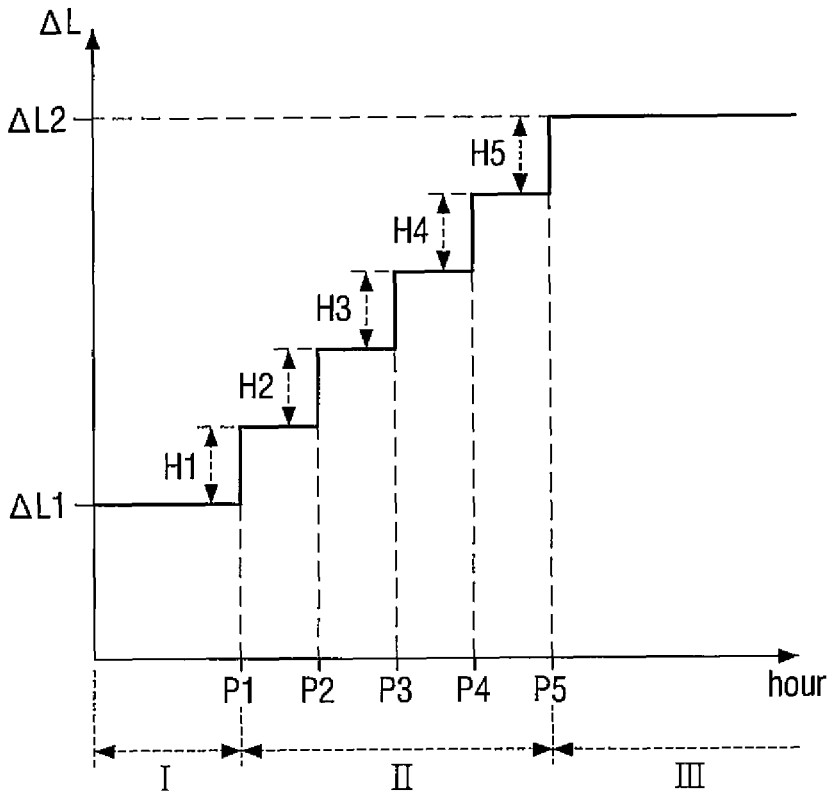
FIGS. 4 and 5 illustrate a deterioration compensation scheme of an organic light emitting display device according to an embodiment of the present invention.
Figure 5:
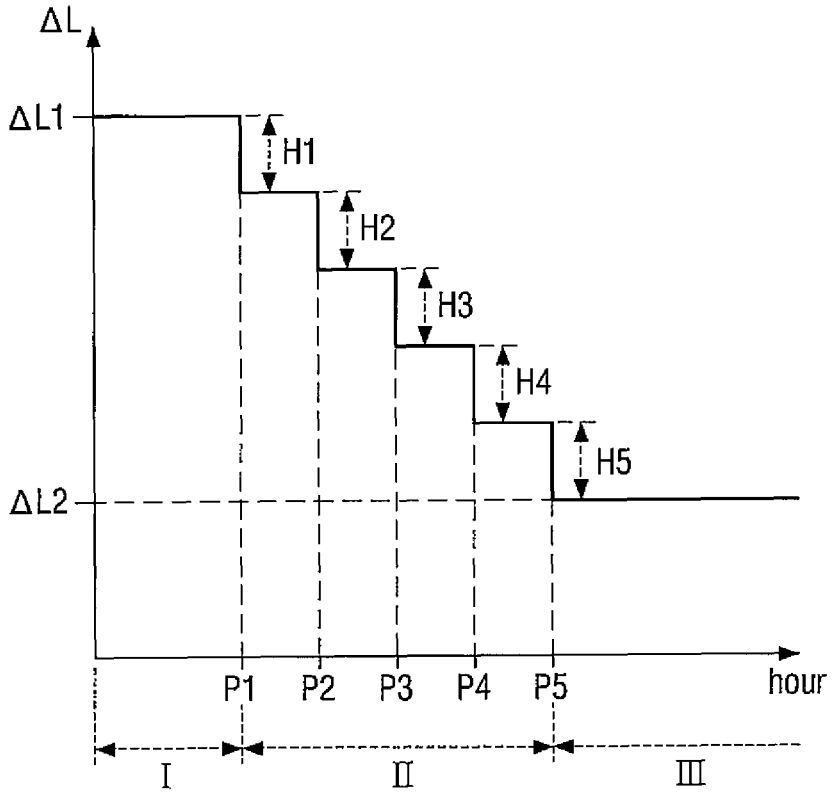

FIGS. 4 and 5 illustrate a deterioration compensation scheme of an organic light emitting display device according to an embodiment of the present invention.

Referring to FIG. 4, section I is a section where the accumulated data Adata of each sub-pixel SP has a value smaller than the first reference value. The compensation scheme determination unit 211 may determine the first scheme as the compensation scheme in section I. In other words, the compensation scheme determination unit 211 may compare the accumulated data Adata of each sub-pixel SP with the first reference value, and may determine the first scheme as the compensation scheme if the accumulated data is the first reference value or less.

As such, the compensation amount calculation unit 213 may calculate the deterioration compensation amount ΔL1 according to the first scheme. FIG. 4 shows that the deterioration compensation amount ΔL is constantly ΔL1, but this is only an example. For example, the deterioration compensation amount ΔL of section I may have a change such as a gradual increase with the passage of time.

Section II is a section where the compensation scheme is changed. For example, section II may be a section of a period of time (e.g., a predetermined period of time) from the point of time when the accumulated data Adata of each sub-pixel SP has a value higher than the first reference value, and the compensation scheme determination unit 211 may determine the combined scheme of the first scheme and the second scheme as the compensation scheme in section II. In other words, the compensation scheme determination unit 211 may compare the accumulated data Adata of each sub-pixel SP with the first reference value, and may determine the combined scheme of the first scheme and the second scheme as the compensation scheme for a preset period of time, if the accumulated data Adata exceeds the first reference value by comparing the accumulated data Adata of each sub-pixel SP with the first reference value.

As such, as illustrated in FIG. 4, the compensation amount calculation unit 213 may calculate the deterioration compensation amount ΔL as a value which has gradually increased the deterioration compensation amount ΔL for every compensation point of time (P1, P2, P3, P4, and P5) in the determination of the compensation amount ΔL1 according to the sole application of the first scheme, and the deterioration compensation amount ΔL at the compensation point of time P5 may be a deterioration compensation amount ΔL2 according to the sole application of the second scheme. To this end, if it is confirmed that the accumulated data Adata exceeds the first reference value, the organic light emitting display device 10 may calculate the deterioration compensation amount ΔL2 according to the sole application of the second scheme in advance, and may store the calculated deterioration compensation amount ΔL2.

For example, the compensation amount calculation unit 213 may calculate the deterioration compensation amount ΔL as ΔL1+H1 at the compensation point of time P1, calculate the deterioration compensation amount ΔL as ΔL1+H1+H2 at the compensation point of time P2, calculate the deterioration compensation amount ΔL as ΔL1+H1+H2+H3 at the compensation point of time P3, calculate the deterioration compensation amount ΔL as ΔL1+H1+H2+H3 at the compensation point of time P4, and calculate the deterioration compensation amount ΔL as ΔL1+H1+H2+H3+H4+H5, i.e., ΔL2, at the compensation point of time P5.

In some embodiments, H1, H2, H3, H4, and H5 may be set to have the same value for the equal compensation for every compensation point of time (P1, P2, P3, P4, and P5), but the present invention is not limited thereto. For example, H1, H2, H3, H4, and H5 may be set to have different values. Further, FIG. 4 illustrates a case where the deterioration compensation amount ΔL gradually increases through 5 steps, but the present invention is not limited thereto. For example, the deterioration compensation amount ΔL may gradually increase through more or less steps according to the size difference between the deterioration compensation amount ΔL1 according to the sole application of the first scheme, and the deterioration compensation amount ΔL2 according to the sole application of the second scheme.

Section III is a section after the change of the compensation scheme is completed, and the compensation scheme determination unit 211 may determine the second scheme as the compensation scheme. In other words, the compensation scheme determination unit 211 gradually increases the deterioration compensation amount ΔL1 according to the sole application of the first scheme of the deterioration compensation amount ΔL, and if the deterioration compensation amount ΔL reaches the deterioration compensation amount ΔL2 according to the sole application of the second scheme, the second scheme may be determined as a compensating scheme.

FIG. 4 shows that the deterioration compensation amount ΔL of section III is constantly ΔL2, but this is only an example. For example, the deterioration compensation amount ΔL of section III may have a change, such as a gradual increase with the passage of time.

Referring to FIG. 5, in the present embodiment, the compensation amount calculation unit 213 calculates the deterioration compensation amount ΔL as the value which has gradually decreased the deterioration compensation amount ΔL for every compensation point of time (P1, P2, P3, P4, and P5) in the deterioration compensation amount ΔL1 according to the first scheme.

For example, as illustrated in FIG. 5, the compensation amount calculation unit 213 may calculate the deterioration compensation amount ΔL as the value which has gradually decreased the deterioration compensation amount ΔL for every compensation point of time (P1, P2, P3, P4, and P5) in the deterioration compensation amount ΔL1 according to the first scheme, and may calculate the deterioration compensation amount ΔL2 according to the second scheme at the compensation point of time P5 as the deterioration compensation amount ΔL.

That is, the compensation amount calculation unit 213 may calculate the deterioration compensation amount ΔL as ΔL1−H1 at the compensation point of time P1, calculate the deterioration compensation amount ΔL as ΔL1−H1−H2 at the compensation point of time P2, calculate the deterioration compensation amount ΔL as ΔL1−H1−H2−H3 at the compensation point of time P3, calculate the deterioration compensation amount ΔL as ΔL1−H1−H2−H3 at the compensation point of time P4, and calculate the deterioration compensation amount ΔL as ΔL1−H1−H2−H3−H4−H5, i.e., ΔL2, at the compensation point of time P5.

Figure 6:
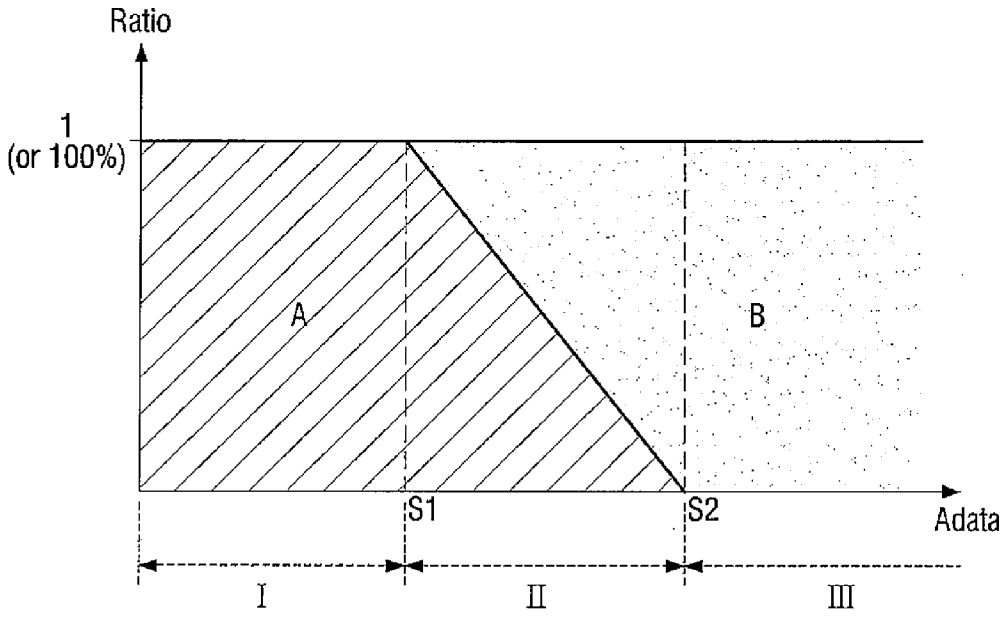
FIG. 6 illustrates a deterioration compensation scheme of an organic light emitting display device according to another embodiment of the present invention.

FIG. 6 illustrates a deterioration compensation scheme of an organic light emitting display device according to another embodiment of the present invention. The horizontal axis of the graph of FIG. 6 indicates the accumulated data Adata of each sub-pixel SP, and the vertical axis indicates the deterioration compensation ratio.

Referring to FIG. 6, section I is a section where the accumulated data Adata of each sub-pixel SP has a value smaller than the first reference value S1. The compensation scheme determination unit 211 of the organic light emitting display device 10 according to an embodiment of the present invention may determine the first scheme A in section I as the compensation scheme. In other words, the compensation scheme determination unit 211 may compare the accumulated data Adata of each sub-pixel SP with the first reference value S1, and if the accumulated data Adata is smaller than the first reference data S1, the compensation scheme determination unit 211 may determine the first scheme A as the compensation scheme. That is, the deterioration compensation ratio of the first scheme A in section I may be 1 (or 100%).

Section II is a section where the compensation scheme is changed. For example, section II may be a section where the accumulated data Adata of each sub-pixel SP is greater than the first reference value S1, but smaller than the second reference value S2, and the compensation scheme determination unit 211 may determine the combined scheme of the first scheme and the second scheme in section II as the compensation scheme. In other words, the compensation scheme determination unit 211 may compare the accumulated data Adata of each sub-pixel SP with the first reference value S1 and the second reference value S2, and if the accumulated data Adata is greater than the first reference value S1, but is less than or equal to the second reference value S2, the compensation scheme determination unit 211 may determine the combined scheme of the first scheme and the second scheme as the compensation scheme.

For example, as illustrated in FIG. 6, the compensation scheme determination unit 211 may gradually reduce the deterioration compensation ratio of the first scheme A as the accumulated data Adata increases in section II, and may gradually increase the deterioration compensation ratio of the second scheme B as the deterioration compensation ratio of the first scheme A decreases.

That is, the sum of the deterioration compensation ratio of the first scheme A and the deterioration compensation ratio of the second scheme B may be 1. For example, when the deterioration compensation ratio of the first scheme A is 0.8, the deterioration compensation ratio of the second scheme B is 0.2. Further, when the deterioration compensation ratio of the first scheme A becomes 0.3 by the reduction of the deterioration compensation ratio of the first scheme A due to the gradual increase of the accumulated data Adata, the deterioration compensation ratio of the second scheme B may be 0.7. In section II, the deterioration compensation ratio of the first scheme A gradually decreases and becomes 0, and as the deterioration compensation ratio of the first scheme A decreases, the deterioration compensation ratio of the second scheme B gradually increases and may become 1.

FIG. 6 illustrates a case where the deterioration compensation ratio of the first scheme A in section II decreases in a straight line, but the present invention is not limited thereto. For example, the deterioration compensation ratio of the first scheme A may decrease in a curved line or in steps (e.g., a stairs form).

Section III is a section after the change of the compensation scheme is completed, and the compensation scheme determination unit 211 may determine the second scheme B as the compensation scheme. In other words, the compensation scheme determination unit 211 may compare the accumulated data of each sub-pixel SP with the second reference value S2, and if the accumulated data Adata exceeds the second reference value S2, the compensation scheme determination unit 211 may determine the second scheme B as the compensation scheme. That is, in section III, the deterioration scheme ratio of the second scheme B may be 1 (or 100%).

The above described first scheme may be a deterioration compensation scheme which uses a look-up table including the deterioration compensation amount compared to the accumulated data Adata of each sub-pixel SP, and may also be a deterioration compensation scheme which uses the relation equation or operation logic, which uses the accumulated data as a variable and uses the deterioration compensation amount as an output. That is, the first scheme may perform quick deterioration compensation in the initial operation of the deterioration process by performing the deterioration compensation without sensing a voltage or current, which separately flows through the organic light emitting device. However, the first scheme is not limited thereto, and various compensation schemes which use the data or relational equation which has been stored in advance may be used.

The above-described second scheme may be a scheme which senses a data current Ioled, which flows through the organic light emitting device (OLED), e.g., a current which flows through the driving transistor Tdr, and compensates deterioration based thereon. To this end, the organic light emitting display device 10 according to an embodiment of the present invention is not separately displayed in the drawings, but may include a detection circuit for detecting the data current Ioled which flows through the OLED. The second scheme may perform accurate deterioration compensation compared to the first scheme in the situation when there has already been some deterioration. However, the second scheme is not limited thereto.

In the organic light emitting display device 10 according to an embodiment of the present invention, a first reference value and a second reference value for determining the deterioration compensation scheme of each sub-pixel may be individually selected in consideration of the characteristics of each sub-pixel.

For example, the display panel 100 includes a first sub-pixel and a second sub-pixel, and the first reference value corresponding to the first sub-pixel may be different from the first reference value corresponding to the second sub-pixel. Further, the second reference value corresponding to the first sub-pixel may be different from the second reference value corresponding to the second sub-pixel.

Figure 7:
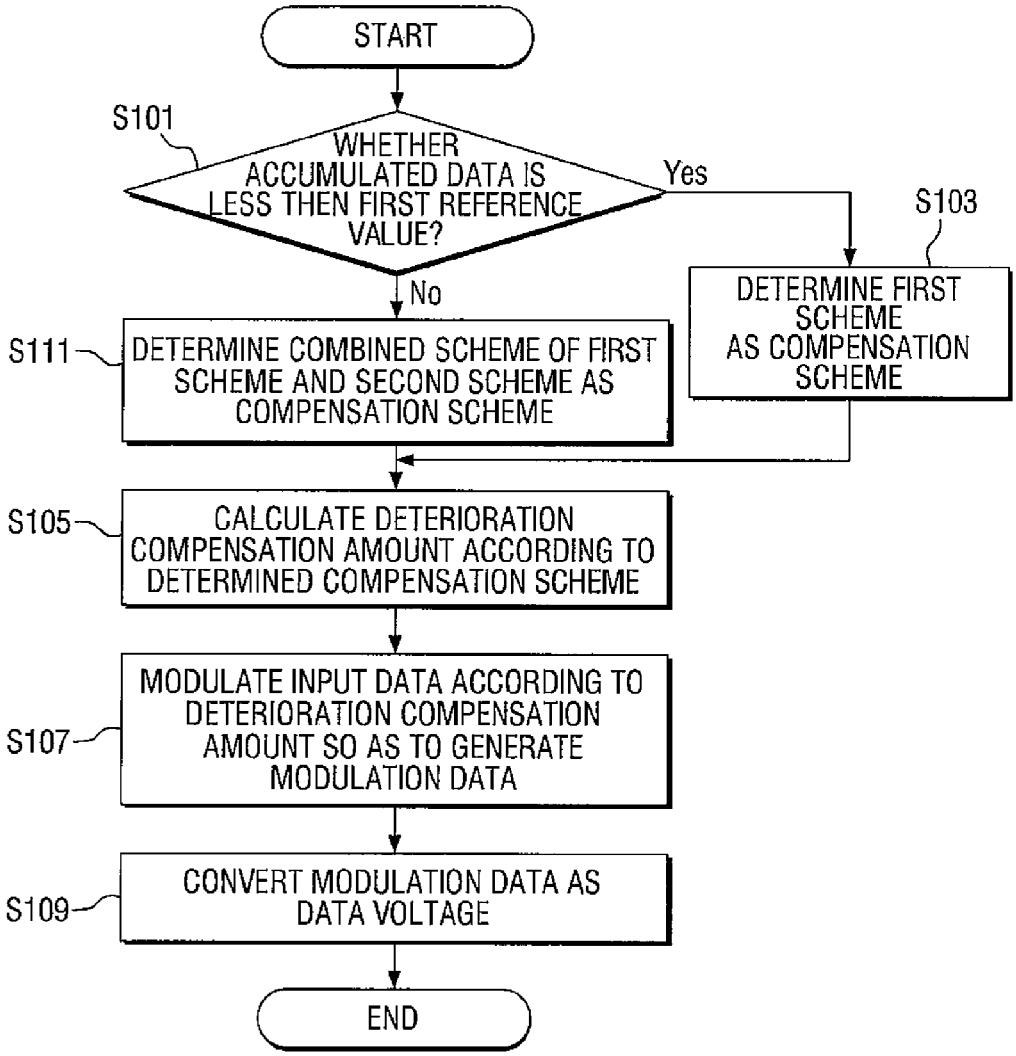
FIG. 7 is a flowchart illustrating a method of driving an organic light emitting display device according to an embodiment of the present invention.

FIG. 7 is a flowchart illustrating a method of driving an organic light emitting device according to an embodiment of the present invention.

Referring to FIG. 7, the method of driving an organic light emitting display device 10 having a display panel 100 including a plurality of sub-pixels SP, each sub-pixel SP having an organic light emitting device (OLED) which is light-emitted by the data current lobed corresponding to the data voltage, according to an embodiment of the present invention may be performed including a series of operations. First, the organic light emitting display device 10 compares the accumulated data Adata of each sub-pixel SP stored in the memory for every compensation point of time with the preset first reference value, so as to check whether the accumulated data is the first reference value or less (S101).

As a result of the checking in the operation S101, if the accumulated data is the first reference value or less, the organic light emitting display device 10 determines the first scheme as the deterioration compensation scheme (S103).

Thereafter, the organic light emitting display device 10 calculates the determined compensation scheme, e.g., the deterioration compensation amount for increasing or reducing the luminance of each sub-pixel SP according to the first scheme (S105). The first scheme may be a deterioration compensation scheme which uses a look-up table including the deterioration compensation amounts compared to the accumulated data Adata of respective sub-pixels SP, or a deterioration compensation scheme that uses the relational equation or operation logic, which uses the accumulated data as the variable and the deterioration compensation amount as the output.

Thereafter, the organic light emitting device 10 modulates input data Idata to be supplied to each sub-pixel SP according to the calculated deterioration compensation amount, so as to generate the modulation data Mdata of each of the sub-pixels SP (S107).

Thereafter, the organic light emitting display device 10 arranges the modulation data Mdata of each sub-pixel SP as the pixel data DATA according to the pixel-arrangement structure of the display panel 100, and converts the pixel data DATA as the data voltage Vdata (S109).

On the other hand, as a result of the checking in the operation S101, if the accumulated data exceeds the first reference value, the organic light emitting display device 10 may determine the combined scheme of the first scheme and the second scheme as the deterioration compensation scheme (S111).

Thereafter, the organic light emitting display device 10 calculates the deterioration compensation amount for increasing or decreasing the luminance of each sub-pixel SP in the determined compensation scheme, e.g., the combination scheme of the first scheme and the second scheme (S105).

For example, the organic light emitting display device 10 may gradually increase or decrease the deterioration compensation amount at a plurality of respective compensation points of time from the deterioration compensation amount according to the sole application of the first scheme. As such, if the deterioration compensation amount reaches the deterioration compensation amount according to the sole application of the second scheme, the second scheme may be determined as the compensation scheme, which may minimize or reduce the display image change according to the change of the deterioration compensation scheme from the first scheme to the second scheme.

Thereafter, the above described operations S107 and S109 may be performed according to the calculated deterioration compensation amount.

Figure 8:
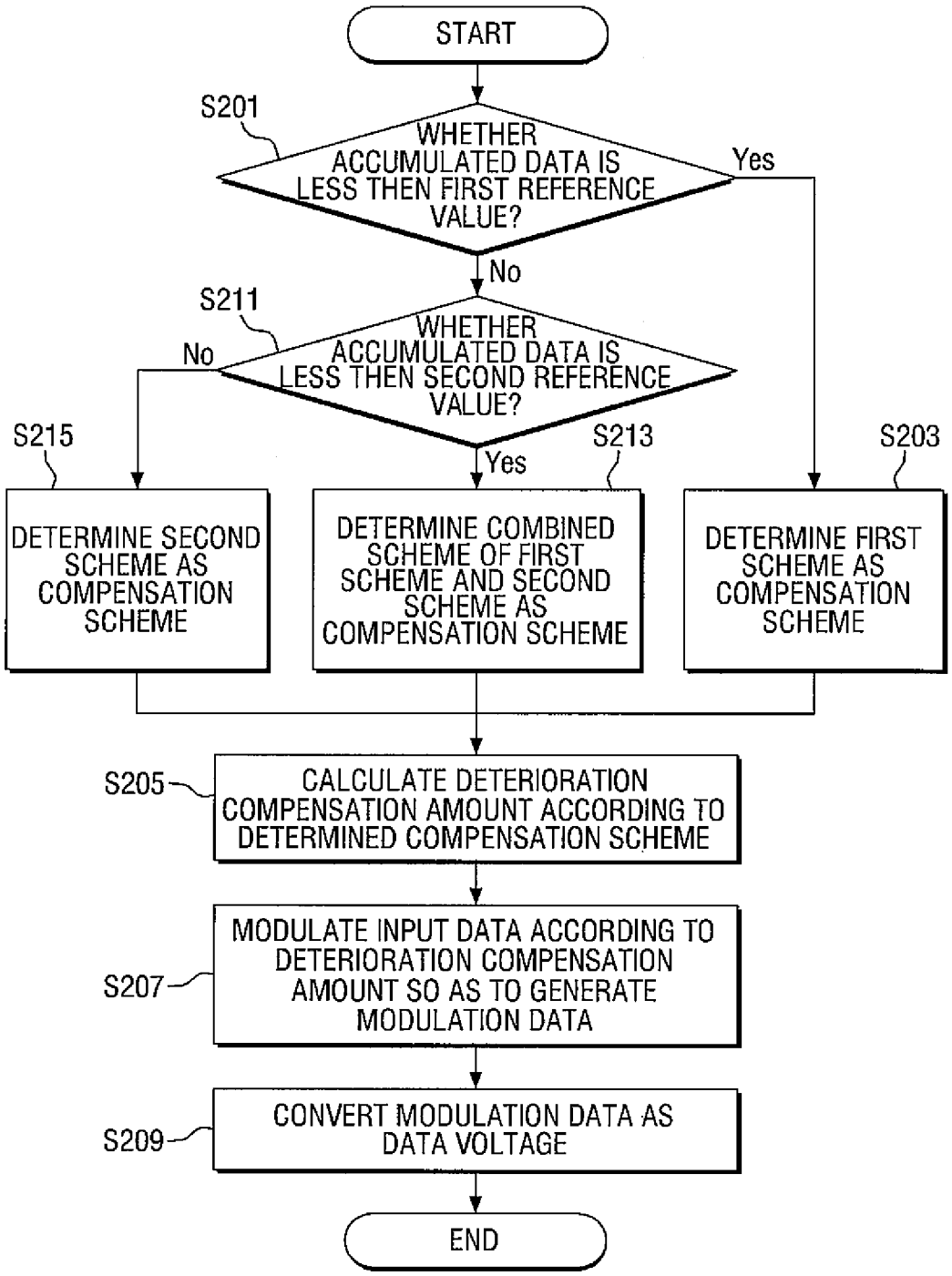
FIG. 8 is a flowchart illustrating a method of driving an organic light emitting display device according to another embodiment of the present invention.

FIG. 8 is a flowchart illustrating a method of driving an organic light emitting device according to another embodiment of the present invention.

Referring to FIG. 8, a method of driving the organic light emitting display device 10 having a display panel 100 including a plurality of sub-pixels SP, each of the sub-pixels SP having an organic light emitting device (OLED) that is emitted by the data current Ioled corresponding to the data voltage, according to another embodiment of the present invention may be performed including a series of operations. First, the organic light emitting display device 10 may compare the accumulated data Adata of each sub-pixel SP stored in the memory 300 with the first reference value for every compensation point of time, and may check whether the accumulated data is the first reference value or less (S201).

As a result of the operation S201, if the accumulated data is the first reference value or less, operations S203, S205, S207, and S209 may be sequentially performed in the same or substantially the same manner as that in the above described operations S103, S105, S107, and S109.

On the other hand, as a result of the operation S201, if the accumulated data exceeds the first reference value, the organic light emitting display device 10 checks whether the accumulated data is the second reference value or less (S211).

As a result of the operation S211, if the accumulated data is the second reference value or less, the organic light emitting display device 10 determines the deterioration compensation scheme in the combined method of the first scheme and the second scheme (S213).

Thereafter, the organic light emitting display device 10 calculates the deterioration compensation amount for increasing or reducing the luminance of each sub-pixel SP in the compensation method determined in the operation S213, e.g., the combined method of the first scheme and the second scheme (S205).

For example, the organic light emitting display device 10 may gradually decrease the deterioration compensation ratio of the first scheme, and gradually increase the deterioration compensation ratio of the second scheme by as much as the reduction of the deterioration compensation ratio of the first scheme. That is, the combination (e.g., sum) of the deterioration compensation ratio of the first scheme and the deterioration compensation ratio of the second scheme may be 1 (or 100%). The deterioration compensation ratio of the first scheme may gradually decrease so as to become 0, and the deterioration compensation ratio of the second scheme may gradually increase by as much as the reduction of the deterioration compensation ratio of the first scheme so as to become 1.

Thereafter, according to the calculated deterioration compensation amount, the operations S207 and S209 may be performed in substantially the same manner as that in the above described operations S107 and S109.

On the other hand, as a result of operation S211, if the accumulated data exceeds the second reference value, the organic light emitting display device 10 may determine the deterioration compensation scheme as the second scheme (S215).

Thereafter, the organic light emitting display device 10 calculates the deterioration compensation amount for increasing or decreasing the luminance of each sub-pixel SP according to the determined compensation scheme, e.g., the second scheme (S205). The second scheme may be a scheme which senses the data current Ioled that flows through the organic light emitting device (OLED), e.g., the current that flows through the driving transistor Tdr, and may compensate for the deterioration based thereon.

Thereafter, according to the calculated deterioration compensation amount, the operations S207 and S209 may be performed in substantially the same manner as in the above described operations S107 and S109.

According to one or more embodiments of the present invention, the following features and aspects may be achieved.

In the organic light emitting display device and method of driving the same according to some embodiments of the present invention, luminance deterioration and luminance deviation (e.g., variation) due to deterioration of the organic light emitting device may be reduced, the afterimage due to the luminance deviation may be improved, and the lifespan of the organic light emitting device may be extended.

Although the present invention has been described with reference to the example embodiments, those skilled in the art will recognize that various changes and modifications to the described embodiments may be performed, all without departing from the spirit and scope of the present invention. Furthermore, those skilled in the various arts will recognize that the present invention described herein will suggest solutions to other tasks and adaptations for other applications. It is the applicant's intention to cover by the claims herein, all such uses of the present invention, and those changes and modifications which could be made to the example embodiments of the present invention herein chosen for the purpose of disclosure, all without departing from the spirit and scope of the present invention. Thus, the example embodiments of the present invention should be considered in all respects as illustrative and not restrictive, with the spirit and scope of the present invention being indicated by the appended claims and their equivalents.

What is claimed is:

1. An organic light emitting display device comprising: a display panel comprising a plurality of sub-pixels, each of the sub-pixels comprising an organic light emitting device configured to be light-emitted by a data current based on a data voltage; a memory to store accumulated data to be displayed on each of the sub-pixels; a deterioration compensator comprising: a compensation scheme determiner to determine a first scheme from among a plurality of compensation schemes as a deterioration compensation scheme when the accumulated data is less than or equal to a first reference value and to determine at least one other scheme from among the plurality of compensation schemes as the deterioration compensation scheme when the accumulated data is greater than the first reference value for each sub-pixel based on the accumulated data of each of the sub-pixels stored in the memory; wherein the at least one other scheme is a combined scheme of the first scheme and a second scheme when the accumulated data is greater than the first reference value but less than or equal to a second reference value, and the at least one other scheme is the second scheme when the accumulated data is greater than the second reference value; a compensation amount calculator to calculate a deterioration compensation amount for increasing or decreasing luminance of each of the sub-pixels according to the determined deterioration compensation scheme; and a modulation data generator to generate modulation data of each of the sub-pixels by modulating input data to be supplied to each of the sub-pixels according to the deterioration compensation amount; a timing controller to arrange the modulation data of each of the sub-pixels as pixel data according to a pixel arrangement structure of the display panel; and a data driver to convert the pixel data into the data voltage.

2. The organic light emitting display device of claim 1, wherein the at least one other scheme is a combined scheme of the first scheme and a second scheme when the accumulated data is greater than the first reference value.

3. The organic light emitting display device of claim 2, wherein the compensation amount calculator is configured to calculate the deterioration compensation amount by gradually increasing or decreasing the deterioration compensation amount according to application of the first scheme, when the combined scheme of the first scheme and the second scheme is determined to be the deterioration compensation scheme.

4. The organic light emitting display device of claim 3, wherein the compensation amount calculator is configured to calculate a difference value between the deterioration compensation amount according to the application of the first scheme and the deterioration compensation amount according to the application of the second scheme, and to calculate the deterioration compensation amount by adding or deducting a size of the difference value to or from the deterioration compensation amount according to application of the first scheme by the size of the difference value for each of a plurality of compensation points of time, when the combined scheme of the first scheme and the second scheme is determined to be the deterioration compensation scheme.

5. The organic light emitting display device of claim 2, wherein the first scheme is a deterioration compensation scheme that utilizes a look-up table comprising the deterioration compensation amount compared to the accumulated data of each of the sub-pixels or a deterioration compensation scheme that utilizes a relational equation utilizing the accumulated data as a variable and the deterioration compensation amount as an output.

6. The organic light emitting display device of claim 2, wherein the second scheme is a scheme that compensates deterioration based on a data current which flows through the organic light emitting device.

7. The organic light emitting display device of claim 2, wherein the display panel comprises a first sub-pixel and a second sub-pixel, and a first reference value corresponding to the first sub-pixel is different from a first reference value corresponding to the second sub-pixel, or a second reference value corresponding to the first sub-pixel is different form a second reference value corresponding to the second sub-pixel.

8. The organic light emitting display device of claim 1, wherein the deterioration compensator further comprises a data accumulator to accumulate the input data in the accumulated data of the sub-pixels, and to store the accumulated input data in the memory.

9. The organic light emitting display device of claim 1, wherein the compensation amount calculator is configured to gradually decrease a deterioration compensation ratio of the first scheme, and to gradually increase the deterioration compensation scheme of the second scheme to calculate the deterioration compensation amount, when the combined scheme of the first scheme and the second scheme is determined to be the deterioration compensation scheme.

10. The organic light emitting display device of claim 9, wherein the compensation amount calculator is configured to gradually decrease a deterioration compensation ratio of the first scheme along with the increase of the accumulated data, and to gradually increase a deterioration compensation ratio of the second scheme along with the increase of the accumulated data to calculate the deterioration compensation amount, when the combined scheme of the first scheme and the second scheme is determined to be the deterioration compensation scheme.

11. The organic light emitting display device of claim 1, wherein the first scheme is a deterioration compensation scheme that utilizes a look-up table comprising the deterioration compensation amount compared to the accumulated data of each of the sub-pixels or a deterioration compensation scheme that utilizes the accumulated data as a variable and a relational equation that utilizes the deterioration compensation amount as an output.

12. The organic light emitting display device of claim 1, wherein the second scheme compensates deterioration based on a data current which flows through the organic light emitting device.

13. The organic light emitting display device of claim 1, wherein the display panel comprises a first sub-pixel and a second sub-pixel, and a first reference value corresponding to the first sub-pixel is different from a first reference value corresponding to the second sub-pixel, or a second reference value corresponding to the first sub-pixel is different from a second reference value corresponding to the second sub-pixel.

14. The organic light emitting display device of claim 1, wherein the deterioration compensator further comprises a data accumulator to accumulate the input data in the accumulated data of the sub-pixels, and to store the accumulated input data in the memory.

15. A method of driving an organic light emitting display device comprising a display panel comprising a plurality of sub-pixels, each of the sub-pixels comprising an organic light emitting device configured to be light-emitted by a data current based on a data voltage, the method comprising: comparing whether the accumulated data of each of the sub-pixels stored in the memory is less than or equal to a first reference value; determining a first scheme from among a plurality of compensation schemes as a deterioration compensation scheme when the accumulated data is less than or equal to the first reference value and determining at least one other scheme from among the plurality of compensation schemes as the deterioration compensation scheme when the accumulated data is greater than the first reference value for each of the sub-pixels based on accumulated data of each of the sub-pixels stored in a memory, wherein the at least one other scheme is a combined scheme of the first scheme and a second scheme when the accumulated data is greater than the first reference value but less than or equal to a second reference value, and the at least one other scheme is the second scheme when the accumulated data is greater than the second reference value; calculating a deterioration compensation amount for increasing or decreasing luminance of each of the sub-pixels according to the determined deterioration compensation scheme; generating modulation data of each of the sub-pixels by modulating input data to be supplied to each of the sub-pixels according to the deterioration compensation amount; arranging the modulation data of each of the sub-pixels as pixel data according to a pixel arrangement structure of the display panel; and converting the pixel data as the data voltage.

16. The method of claim 15, where the first scheme is a deterioration compensation scheme that utilizes a look-up table comprising the deterioration compensation amount compared to the accumulated data of each of the sub-pixels or a deterioration compensation scheme that utilizes the accumulated data as a variable and utilizes a relational equation that utilizes the deterioration compensation amount as an output.

17. The method of claim 15, wherein the second scheme compensates deterioration based on a data current that flows through the organic light emitting device.

* * * * *